United States Patent [19]

Nakayama et al.

[11] 4,383,403

[45] May 17, 1983

[54] MULTICOLORED YARN AND METHOD

[75] Inventors: Takashi Nakayama, Ohtsu; Kohji Kajita, Ohmihachiman; Seiichi Yamagata, Ohtsu, all of Japan

[73] Assignee: Toray Industries, Inc., Japan

[21] Appl. No.: 238,566

[22] Filed: Feb. 26, 1981

Related U.S. Application Data

[63] Continuation of Ser. No. 56,391, Jul. 10, 1979, abandoned.

[30] Foreign Application Priority Data

Jul. 10, 1978 [JP] Japan ..... 53-82972

[51] Int. Cl.[3] ..... D02G 3/00; D01H 13/00

[52] U.S. Cl. ..... 57/207; 57/209; 428/369; 428/370; 428/377; 428/399; 428/400

[58] Field of Search ..... 57/206, 207, 209, 210, 57/224, 328; 428/373, 377, 364, 397, 399, 400, 428/369, 370

[56] References Cited

U.S. PATENT DOCUMENTS 3,205,648 9/1965 Lohrke ..... 57/206

*Primary Examiner*—Lorraine T. Kendell

*Attorney, Agent, or Firm*—Austin R. Miller

[57] ABSTRACT

A multicolored spun yarn is provided which comprises a substantially untwisted bundle of core staple fibers and a plurality of staple fibers wrapped helically around said bundle of core staple fibers; the bundle of core staple fibers comprise a plurality of staple fibers which are different from each other in color tone or in dyeability, and the yarn having at random intervals portions wherein staple fibers of one kind cover up staple fibers of another kind, and the method of manufacturing the same.

6 Claims, 13 Drawing Figures

MULTICOLORED YARN AND METHOD

This is a continuation, of application Ser. No. 056,391, filed July 10, 1979, and now abandoned.

FIELD OF THE INVENTION

The present invention relates broadly to spun yarns and more particularly to a multicolored yarn in which there are variances in the color tone along its length, and further, relates to a method for manufacturing such yarn.

DESCRIPTION OF THE PRIOR ART

In the manufacture of cloth, such as for curtains for interior decoration, fancy yarns have come to be frequently used in recent years to produce more variety in surface effect and thereby to heighten the value added to merchandise. Multicolored yarns, as well as nep yarns, slub yarns, etc., are being employed for such purpose. However, these multicolored yarns are, for the most part, mottled yarns consisting of staples in two or three different colors twisted at a predetermined angle, or the like. Multicolored yarns in which there are variances in color along the yarn length are scarcely in use.

This is because great difficulty is involved in the manufacture of such yarn. To manufacture a multicolored yarn in which, for instance, two colors alternate with each other along its length, it is sufficient to feed, to the spinning frame, slivers in two different colors arranged alternately in a random cycle. However, it is very difficult to control the feed so as to prevent such difficulties as the occurrence of yarn breaks, slubs, etc., at points where the two different slivers alternate with each other. Even if the feeding of the slivers could be controlled by using special care, the spinning speed would naturally be reduced, resulting in lower productivity.

Another method for manufacturing a multicolored yarn is to print a plain yarn at intervals along its length, but such a method is generally not employed because it entails a higher cost of production.

SUMMARY OF THE INVENTION

An object of the present invention is to provide a multicolored yarn in which there are differences in yarn color tone along its length, and to make it without encountering such drawbacks as are incidental to the conventional methods of manufacturing such yarn, to provide a yarn whose outward appearance has a much stronger design effect than that of conventional types of multicolored yarn manufactured by ring spinning, and to provide a method for manufacturing such multicolored yarn.

A further object of this invention is to provide, in particular, a multicolored yarn which is best suited for the manufacture of cloths, such as curtains, for interior decoration, and to provide a method for manufacturing such yarn.

One of the above objects is achieved by obtaining a multicolored yarn having the following characteristics: A spun yarn consisting of a substantially untwisted bundle of core staple fibers and several wrapping staple fibers which are wrapped helically around the bundle of core staple fibers. The bundle of core staple fibers comprises a plurality of staple fibers, different from each other in color tone or in dyeability, and have, at random intervals, portions where staple fibers of one kind cover the other fiber or fibers, and portions where at least two kinds of fiber components lie adjacent to each other.

Another object is attained by providing a method of manufacturing multicolored yarns which is characterized by the following: A plurality of slivers or rovings, different from each other in color tone or in dyeability, are simultaneously drafted, and placed adjacent to each other or with a small space between them. The drafted slivers or rovings are fed through the nip rollers and are twisted, thereby producing a twisted bundle of staple fibers and freeing outside staple fibers which are not twisted into said bundle of staple fibers. Then, the twisted bundle of staple fibers and the free, outside staple fibers, which have not been twisted into said bundle of staple fibers, are integrated into a whole, and then detwisted and taken up by a winder.

DRAWINGS

DETAILED DESCRIPTION OF THE INVENTION

Figure 1A:
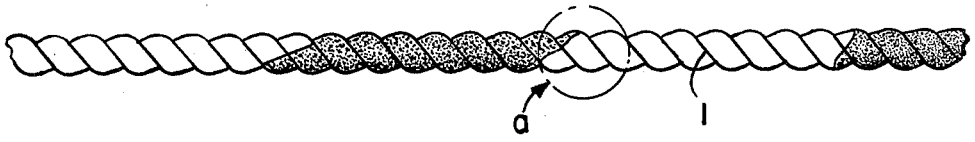
FIGS. 1A, 1B and 1C are illustrations showing the outward appearance of a multicolored yarn in accordance with the present invention in which two colors are used, with FIG. 1C being an enlargement of part "a" of FIG. 1A.
Figure 1B:
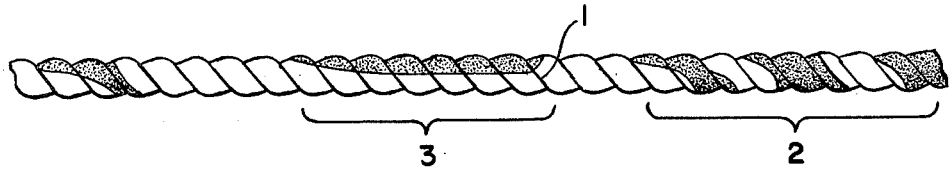
Figure 1C:
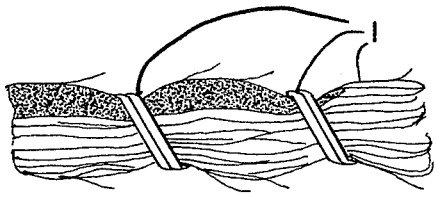

The multicolored yarn of the present invention is a spun yarn consisting of a substantially untwisted bundle of core staple fibers and several wrapping staple fibers wrapped helically around said bundle of core staple fibers. The bundle of core staple fibers comprises a plurality of staple fibers which are different from each other in color tone or in dyeability, and have, at random intervals, portions where staple fibers of one kind cover the other fiber or fibers and portions where at least two kinds of fiber components lie adjacent to each other. FIGS. 1A–1C show a multicolored yarn according to the present invention in which two colors are used.

In FIG. 1A, staple fibers of one color, in the bundle of core staple fibers, almost completely cover those of another color, in turns, and several wrapping staple fibers 1 are wrapped helically around said bundle of core staple fibers in the same style, thereby giving the yarn the appearance of changes in color along its length as seen from any direction.

In FIG. 1B, on the other hand, the bundle of core staple fibers is composed of two kinds of staple fibers lying adjacent to each other, and here too, several wrapping staple fibers 1 are wrapped helically around the bundle of core staple fibers.

While the bundle of core staple is substantially untwisted, it sometimes happens that there remains a soft, alternate twist 2 where the two kinds of component staple fibers are disposed as in a mottled yarn and/or portions where they are disposed in parallel as indicated at 3 in FIG. 1B;

The multicolored yarn of the present invention may have the two kinds of portions with characteristic structures, as shown in FIGS. 1A and 1B, at random intervals in a single yarn.

As for the wrapping staple fibers 1, they are the same color in some portions with the core staple fibers appearing on the surface in the neighborhood of the wrapping point, and are of a different color in others. That is, when the wrapping fibers alone are observed in the multicolored yarn of the present invention, they consist of a plurality of staple fibers which are different from each other in color tone or in dyeability, and appear at random, one after the other. This is also a very distinguishing feature of the present invention.

FIG. 1C is an enlargement of the portion "a" of FIG. 1A, and, as can be seen, there are several wrapping staple fibers 1 wrapped helically around the untwisted bundle of core staple fibers.

Figure 2A:
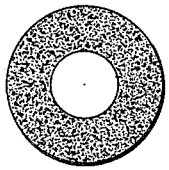
FIGS. 2A, 2B and 2C are sectional views of the representative portions of a multicolored yarn according to the present invention.
Figure 2B:
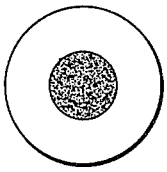
Figure 2C:
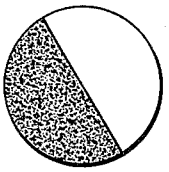

FIGS. 2A, 2B and 2C are sectional views representing portions of a multicolored yarn of the present invention.

As illustrated in FIGS. 2A and 2B, in the portion corresponding to the portion shown in FIG. 1A, staple fiber components of one kind, in the bundle of core staple fibers, cover those of another kind. In such portions, the color of staple fibers lying on the outside is seen as the color of the yarn. Therefore, the yarn of the present invention, by having such portions at random intervals, looks like a yarn wherein the color varies along its length.

FIG. 2C shows the bundle of core staple fibers in which two kinds of staple fibers lie adjacent to each as shown in FIG. 1B. In this portion, the yarn presents two colors simultaneously, and when there exists a soft, alternate twist, the yarn presents an outward appearance having a variety of color tones like a mottled yarn. Further, there exists practically no twist in the yarn contrary to the conventional types of multicolored yarns.

In viewing the yarn shown in FIG. 2C, the color as seen from one direction is clearly distinguishable from the color as seen from another direction.

Since, in the yarn of the present invention, several wrapping fibers wind around the bundle of core fibers which has varied color tones as described in the foregoing, the form of the yarn itself is such that there are swells in the bundle of core fibers. By regulating the winding pitch of the wrapping fibers, it is not difficult to make such swells larger to obtain fancy twisted yarns, or to make the swells smaller to obtain a straight yarn. Thus, it is possible to impart to the yarn a much greater design effect than that of conventional types of multicolored yarns.

Furthermore, in the multicolored yarn of the present invention, while the plurality of staple fibers used are different from each other in color tone or in dyeability, they can also differ in the degree of luster. It is therefore possible to obtain a multicolored yarn with a still more distinctive character which is not seen in conventional types of multicolored yarn.

It is to be noted that, when the plurality of staple fibers of a yarn are clearly different from each other in the degree of luster, even though they are similar or about the same in color tone or in dyeability, and when, accordingly, such yarn is obviously recognized from color shade, glare, etc., as consisting of a plurality of staple fibers, such yarn comes within the scope of the multicolored yarns of the present invention.

A multicolored yarn of the present invention can be manufactured by the following method: A plurality of slivers or rovings, which are different from each other in color tone or in dyeability, are simultaneously drafted, placed adjacent to each other or with a small space between them. The drafted slivers or rovings are fed through the nip rollers and are twisted, thereby producing a twisted bundle of staple fibers and free outside staple fibers which are not twisted into said bundle of core staple fibers. Then, the twisted bundle of staple fibers and the free outside staple fibers, which have not been twisted into the bundle of staple fibers, are integrated into a whole, and then detwisted and taken up by a winder.

Figure 3:
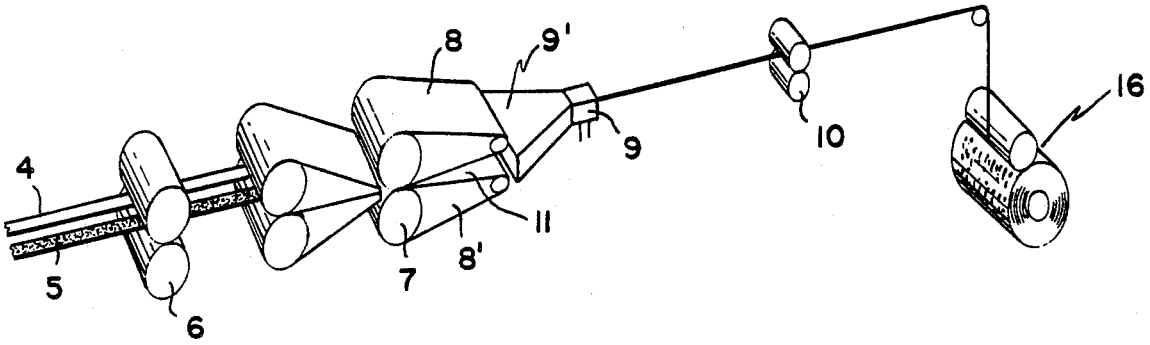
FIG. 3 is a schematic representation of an example of the device embodying the present invention.

FIG. 3 illustrates an example of the above method of manufacturing the multicolored yarn according to the present invention.

Explanations are given here in the case of two colors being used. Two kinds of slivers 4 and 5, which are different in color tone, are fed through back rollers 6, where it is necessary to feed the two kinds of slivers 4 and 5 adjacent to each other or, as shown in FIG. 3, with a small space between them. When one sliver is overlaid with another, the yarn of the present invention cannot be obtained.

The fed slivers are drafted between the back rollers 6 and front rollers 7; the drafted slivers are nipped by the front rollers 7 and are fed between conveyor belts 8 and 8', and subjected to twisting by fluid vortex nozzle 9. Then, the twisted bundle of fibers, after passing through said nozzle, passes through delivery rollers 10 and is taken up by a winder 16. The front rollers 7 are provided with a pair of upper and lower conveyor belts 8 and 8', referred to above, opened toward their ends to form a wedge-like space 11, thereby making it possible to adequately control the transmission of the bundle of fibers twisted by the fluid vortex nozzle 9 and the free, outside fibers which have not been twisted in the bundle by false twisting.

Subsequently, the twisted bundle of fibers, and the free, outside fibers which have not been twisted into it, are integrated into a whole, and then detwisted, thereby obtaining a spun yarn which consists of a substantially untwisted bundle of core staple fibers and several wrapping stable fibers winding around it, as shown in FIGS. 1A–1C.

Now, the method by which a multicolored yarn of the present invention is formed will be explained with reference to FIGS. 4A–4C, which reveal, with the upper conveyor belt removed, the conditions between the front rollers 7 and the fluid vortex nozzle 9.

The two kinds of slivers 4 and 5 are, after having been drafted through back rollers 6 (shown in FIG. 3), nipped by the front rollers 7 and fed into the space 11 between front rollers 7 and the fluid vortex nozzle 9, wherein they are subjected to a twisting action by the latter. Since the slivers are fed, after having been nipped and flattened by the front rollers 7, not all of the component staple fibers are subjected to the twisting action. The fibers located in the neighborhood of the two outside borders escape the effect of the twisting action. Thus, the fibers at the two outside borders are transmitted as free fibers 12. That is, free fibers arise at the outside of the twisted bundle of fibers.

Figure 4A:
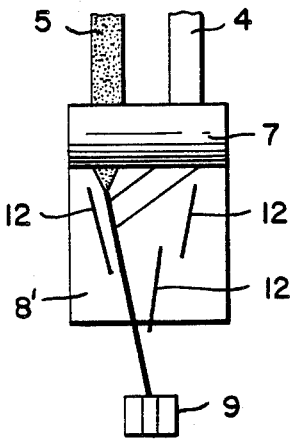
FIGS. 4A, 4B and 4C illustrate the method by which the yarn is formed in the present invention, two colors being used in this instance.
Figure 4B:
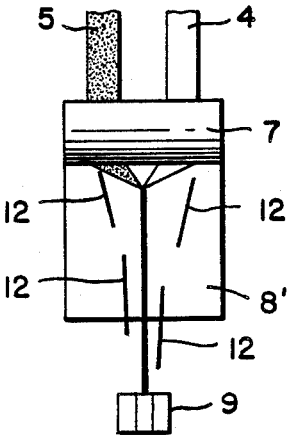
Figure 4C:
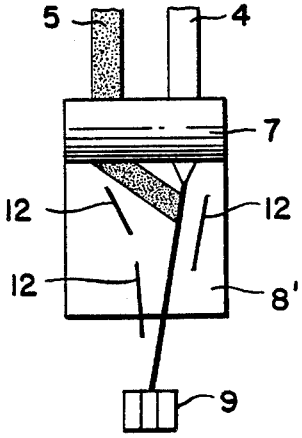

In this instance, the center of twist of the twisted bundle of fibers spontaneously shifts sideways at random, as illustrated in FIGS. 4A, 4B and 4C.

When the center of twist is located as shown in FIG. 4A, the sliver 5 is twisted first, and the sliver 4 is then twisted over it so as to cover it up. At this time, at the two outside borders free fibers 12 arise which are not involved in the false twist. Such free outside fibers are transmitted, under control of the conveyor belts 8 and 8', to the nozzle 9, where they are integrated with the twisted bundle of fibers. Then, such integrated bundle of fibers is detwisted. In this case, the resultant yarn will have the color of the sliver 4 since the sliver 5 was covered by the sliver 4.

When the center of twist is located as shown in FIG. 4B, the slivers 4 and 5 are subjected simultaneously to the twisting action and will, therefore, form a bundle of core fibers wherein the two kinds of staple fibers lie adjacent to each other. Thus, the resultant yarn will have the colors of both slivers 4 and 5.

Likewise, when the center of twist is located as shown in FIG. 4C, staple fibers of sliver 5 cover up the staple fibers of sliver 4, resulting in a yarn having the color of sliver 5.

Since these shifts of the center of twist take place at random intervals, the yarn obtained changes in color along its length, and also, portions appear where the yarn has two colors, side by side.

The twisting and detwisting processes in the method of this invention can be carried out effectively by utilizing false twisting. That is, the upstream of the device for giving a false twist is the twisting zone, and the downstream is the detwisting zone.

It is most advantageous, from the viewpoint of operational efficiency, etc., to give a false twist by using the fluid vortex nozzle. It will also be advantageous to provide, between the twisting point in the device for giving a false twist and the conveyor belts, a collector for the purpose of positively integrating the twisted bundle of fibers and the free outside fibers into an integrated whole. The fluid vortex nozzle 9, as shown in FIG. 3, simultaneously acts, by virtue of fluid sucking action, as a collector; that is, section 9', where the yarn passage gradually becomes narrower, has the function of a collector.

The apparatus as shown in FIG. 3 is in approximately the same mode as that which is disclosed in U.S. Pat. No. 4,003,194.

In the manufacture of the multicolored yarn of this invention, the way in which the colors arise varies with the degree of twisting in false twisting. When a hard twist is given, more portions where staple fibers of a kind completely cover those of another kind arise, and those portions having two kinds of staple fibers lying adjacent to each other will be limited to the neighborhood of the point where the change of color takes place. In this instance, the winding pitch of the wrapping fibers will become smaller, and the yarn will have an outward appearance of a fancy yarn. On the other hand, when the twist is soft, more portions arise wherein the two kinds of staple fibers lie adjacent to each other.

The degree of twist, as aforesaid, can be adjusted with ease by varying the overfeed rate between the front rollers 7 and the delivery rollers 10 in the apparatus shown in FIG. 3.

According to the present invention, a suitable range of said overfeed rate is 5 to 30 percent, and preferably in the range of 7 to 20 percent, wherein a multicolored yarn is obtained in which there are variances of color in a most desirable manner.

The overfeed rate, as referred to in the present application, is calculated by the following equation:

$$OF = \frac{Vd - Vf}{Vd}$$

wherein Vd is the speed of the delivery rollers, and Vf is the speed of the front rollers.

Figure 5:
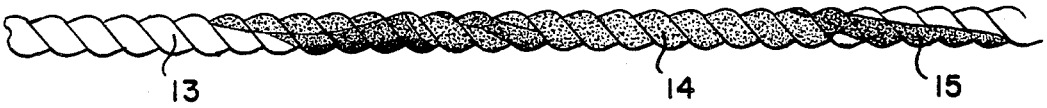
FIG. 5 is an illustration showing the outward appearance of a multicolored yarn according to the present invention in which three colors are used.

FIG. 5 illustrates an example of yarns which are made using three kinds of slivers.

Although three kinds of slivers are fed into the rollers side by side, the basic pattern of formation of the yarn is that staple fibers of one of the side slivers cover those of the other two slivers. There seldom arises a case where staple fibers of the center sliver cover up the surface of the yarn. That is, staple fibers 13 and 14, which completely cover the surface of the yarn, are those slivers placed on the sides when feeding. Staple fibers of the center sliver, in most instances, emerge on the surface adjacent those of the other two kinds of slivers as shown at 15 in FIG. 5. The same applies in those cases where four or more kinds of staple fibers are used.

In the method of this invention, at least one of the plurality slivers or rovings maybe prepared with neps mixed into it. When this kind of sliver or roving is used, a multicolored yarn with a still greater design effect (by virtue of the inclusion of neps) can be obtained.

Still further, when a plurality of slivers or rovings are used which, besides being different from each other in color tone or in dyeability, are also different in the degree of luster, a multicolored yarn with more distinctive features can be obtained. It is also possible to feed a plurality of slivers or rovings which differ from each other only in their degree of luster.

Figure 6:
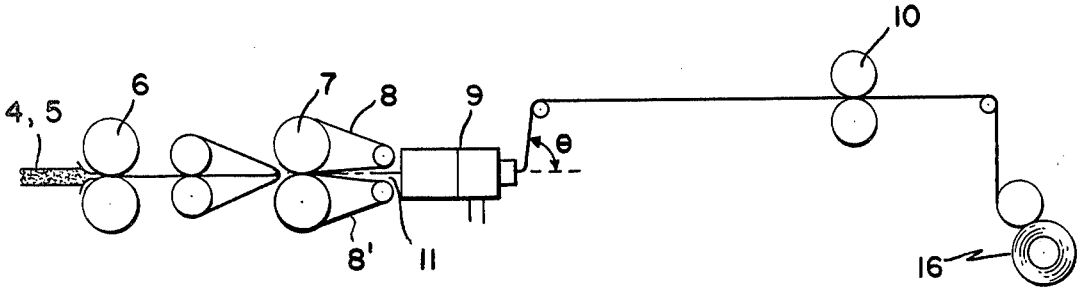
FIG. 6 is a schematic flow diagram showing the method by which, in the present invention, a yarn presenting a very rugged appearance, as viewed in particular from its side, is produced.
Figure 7:
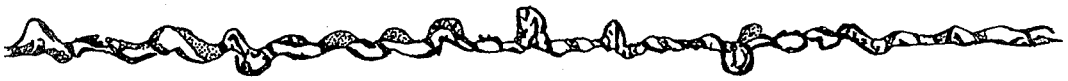
FIG. 7 is an illustration of the outward appearance of a multicolored yarn according to the present invention obtained by the method shown in FIG. 6.

When it is desired to obtain a multicolored yarn which has a very rugged appearance as viewed from its side, it is effective to take up the yarn, after it has passed through the fluid vortex nozzle, at an angle $\theta$ to the direction of the outlet of said nozzle, as shown in FIG. 6. In this instance, a multicolored yarn having an outward appearance with many loop-like knots as illustrated in FIG. 7 is obtained.

In the present invention, a multicolored yarn may be produced either by using slivers or rovings which are different in dyeability; that is, by making them into a plain yarn and then dyeing it, or by using slivers or rovings previously dyed in different color tones.

As described in the foregoing, the multicolored yarn of this invention not only changes its color along its length but also has portions where two or more colors are side by side; and, in addition, it is also possible to give it the style of a fancy yarn. As such, the yarn is particularly useful for the manufacture of cloths for purposes of interior decoration.

Yarns in the range of 1/10 Nm to 1/0.5 Nm, in the metric system of yarn numbers, are especially suitable for the manufacture of cloths for interior decoration since changes of the color are more pronounced in yarns of such thicknesses.

The manufacturing method of the present invention is not confined to that method shown in FIG. 3. Slivers may be fed into the apparatus continuously in the method of this invention, and it is not necessary to feed them intermittently as in the case of conventional methods. As for twisting, it is sufficient to impart only a false twist. Accordingly, the method of this invention permits a spinning operation at a high speed.

Thus, the present invention provides very novel multicolored yarns, which are entirely different from the conventional types of multicolored yarns, as exemplified by, but not limited to, the following examples.

EXAMPLE 1

Using an apparatus as shown in FIG. 3, having a 3-line apron system draft portion, conveyor belts and an air vortex false twisting nozzle, a multicolored yarn was spun out, in accordance with the present invention, under the following conditions:

1. Slivers used:
   (a) Acrylic fiber staples, 3 d.×102 mm, 6 g/m.
   (b) Acid-dyeable acrylic fiber staples, 3 d.×102 mm 3 g/m., and
   (c) Rayon staples, 5 d.×102 mm, 3 g/m.
2. Feeding method:

Three kinds of slivers were arranged side by side in the order of acid-dyeable acrylic, acrylic and rayon, and fed into the back rollers in such a manner as to leave a space of 1 cm between them. A guide was provided behind the back rollers.

3. Draft ratio: 27.4 times.
4. Overfeed rate: 15 percent.

$$(OF = \frac{Vd - Vf}{Vd} \times 100$$

where Vd is the speed of the delivery rollers and Vf is the speed of the front rollers).

5. Air pressure of the air vortex nozzle: 2.0 kg/cm$^2$.
6. Speed of the delivery rollers: 100 m/min.
7. Yarn number of the yarn spun out: ½ Nm.

When the yarn obtained was dyed in such a manner that the acid-dyeable acrylic fiber was dark vermilion, the rayon light vermilion and the acrylic fiber left undyed, it showed a color distribution as shown in FIG. 5, with dark vermilion designated as 13, light vermilion as 14 and white as 15. While the intervals at which the same color emerges are at random, the average was approximately 7 cm.

The yarn produced was uneven in thickness as a result of the wrapping fibers winding helically around the bundle of core fibers and thus compressing the latter, the ratio between the diameters of the constricted portion and of the swelled portion being about 1:1.5–2.

When this yarn was used to inweave a checker design in drape-curtain cloths, both the colored design and style stood out very conspicuously in the curtain obtained, thus producing a highly decorative effect.

EXAMPLE II

Using the same apparatus as in Example I, a multicolored yarn was spun out according to the present invention under the following conditions:

1. Slivers used:
   (a) Acrylic fiber staples, 3 d.×102 mm, mixed with 30% cotton neps, 6.7 g/m.
   (b) Acid-dyeable acrylic fiber staples, 3 d.×102 mm 2.2 g/m. and
   (c) Rayon staples, 50%—5 d.×102 mm; 50%—2.5 d.×76 mm, 2.2 g/m.
2. Feeding method:

Three kinds of slivers were arranged side by side in the order of acrylic fibers/cotton neps, rayon and acid-dyeable acrylic, and were fed into the back rollers in such a manner that they were adjacent to, but not overlapping, one another.

3. Draft: 60 times.
4. Overfeed rate: 10%
5. Speed of the delivery rollers: 100 m/min.
6. Air pressure of the air vortex nozzle: 3.0 kg/cm$^2$.
7. Yarn number of the yarn spun out: 1/5 Nm.

Using the yarns obtained as the weft for the entire length, curtain cloths were woven, and then dyed in such a manner that the acid-dyeable acrylic fiber would be dark blue, the acrylic fiber light blue, and the rayon and cotton neps left undyed. In the curtain cloth obtained, the dark blue portions appeared on the fabric in a slub-like manner and, the neps stood out very conspicuously, thus producing a novel design effect.

EXAMPLE III

Using the apparatus of Example I, a multicolored yarn was spun out, according to the present invention, under the following conditions:

1. Slivers used:
   (a) Polyester fiber staples, 3 d.×102 mm V, 8 g/m.
   (b) Polyester fiber staples (dyed in dark brown), 3 d.×102 mm V, 4 g/m, and
   (c) Polyester fiber staples (dyed in light brown), 3 d.×102 mm V, 4 g/m.
2. Feeding method:

Three kinds of slivers were arranged side by side in the order of white, light brown and dark brown, and then fed into the back rollers in such a manner as to leave a space of about 1 cm between them, with a guide being provided behind the rollers. The overfeed rate was varied in several ways to determine its relationship to the style of yarn obtained.

3. Speed of the delivery rollers: 100 m/min.
4. Air pressure of the air vortex nozzle: 3.2 kg/cm$^2$.
5. Yarn number of the yarn spun out: 1/1 Nm.
6. Overfeed rate:

The relationship between the overfeed rate (OF) and the style of yarn obtained was as follows:

(a) OF 4%: most of the yarn portions had a soft, alternate twist, with the white and dyed staple fibers lying side by side. There was practically no portion where fibers of one kind covered up those of another.
(b) OF 7%: portions having three kinds of fibers lying side by side and portions where one kind of fiber covers up the others existed in about the same proportion. The angular width of spirals of the wrapping fibers was large, and constrictions and swells of the yarn were not as marked.
(c) OF 10%: changes of colors along the length of the yarn were seen more clearly and constrictions and swells of the yarn were marked.
(d) OF 15%: while the color tones were about the same as in the case of (c) above, constrictions and swells were more marked.

Of the yarns having different styles thus obtained, the yarn produced with OF 15% was used for inwoven patterns of a casement cloth. The cloth obtained had a highly decorative effect, with both the colored pattern and the style standing out very conspicuously.

EXAMPLE IV

Using the apparatus of Example I, a yarn was spun out under the following conditions:

1. Slivers used:
   (a) Polyester fiber staples, super bright, 3 d.×102 mm V, 2 g/m. and
   (b) Polyester fiber staples, fully dull, 3 d.×102 mm V, 2 g/m.
2. Feeding method:
   Two kinds of slivers were fed side by side (adjacent to but not overlapping each other).
3. Draft: 35 times.
4. Speed of the delivery rollers: 120 m/min.
5. Air pressure of the air vortex nozzle: 3.2 kg/cm$^2$.
6 Overfeed rate: 10%
7. Yarn number of the yarn spun out: 1/8 Nm.

The yarn obtained alternated super bright and fully dull portions on the surface along its length as illustrated in FIG. 1A.

EXAMPLE V

Using the apparatus as shown in FIG. 6, and with the yarn path bent at an angle of 90° at the outlet of the air vortex nozzle and before feeding the yarn through the delivery rollers for take-up by a winder, a yarn was spun out under the following conditions:

1. Slivers used:
   (a) Nylon staples (dyed in dark brown), 10 d.×152 mm V, 3.5 g/m. and
   (b) Polyester fiber staples, 3 d.×102 mm V, 3.5 g/m.
2. Feeding method:
   Two kinds of slivers were fed side by side with a space of 1 cm between them.
3. Draft: 36 times.
4. Overfeed rate: 30%
5. Speed of the delivery rollers: 110 m/min.
6. Air pressure of the air vortex nozzle: 3.2 kg/cm$^2$.
7. Yarn number of the yarn spun out: 1/4 Nm.

The yarn obtained was very rugged and had loops dispersed throughout as illustrated in FIG. 7. The color changed at a pitch of 3 to 4 cm along the length of the yarn, and there were practically no portion where two colors emerged side by side.

What is claimed is:

1. A multicolored spun yarn comprising a substantially untwisted bundle of core staple fibers and several staple fibers wrapped substantially helically around said bundle of core staple fibers, the said bundle of core staple fibers comprising a plurality of staple fibers which are different from each other in color tone or in dyeability, said yarn having, at random intervals portions wherein staple fibers of one kind cover up staple fibers of another kind, and said yarn having other portions wherein at least two kinds of fibers lie adjacent to each other.

2. A multicolored spun yarn as claimed in claim 1, wherein two or more kinds of staple fibers which are different from each other in color tone or in dyeability come out at random to constitute said wrapping staple fibers.

3. A multicolored spun yarn as claimed in claim 1 having a thickness in the range of about 1/10 Nm to 1/0.5 Nm, using the metric yarn numbering system.

4. A multicolored spun yarn as claimed in claim 1, wherein said plurality of staple fibers differ from each other in degree of luster.

5. A multicolored spun yarn as claimed in claim 1, wherein neps are included in one of said fiber components.

6. A multicolored spun yarn as claimed in claim 3, having a thickness in the range of about 1/10 Nm to 1/0.5–2 Nm, using the metric yarn numbering system.

* * * * *